US006616419B2

(12) United States Patent
Watanabe et al.

(10) Patent No.: US 6,616,419 B2
(45) Date of Patent: Sep. 9, 2003

(54) VARIABLE DISPLACEMENT PUMP

(75) Inventors: Makoto Watanabe, Tochigi (JP); Toshiya Tatsumoto, Tochigi (JP); Hirotoshi Mochiyama, Tochigi (JP)

(73) Assignee: Showa Corporation (JP)

( * ) Notice: Subject to any disclaimer, the term of this patent is extended or adjusted under 35 U.S.C. 154(b) by 0 days.

(21) Appl. No.: 10/091,947

(22) Filed: Mar. 6, 2002

(65) Prior Publication Data

US 2003/0007875 A1 Jan. 9, 2003

(30) Foreign Application Priority Data

Jul. 6, 2001 (JP) ..... 2001-207118

(51) Int. Cl.[7] ..... F04B 49/00

(52) U.S. Cl. ..... 417/220; 417/310; 417/213; 418/26

(58) Field of Search ..... 417/220, 559, 417/310, 213; 418/30, 26

(56) References Cited

U.S. PATENT DOCUMENTS 5,518,380 A 5/1996 Fujii et al. ..... 418/26
5,538,400 A 7/1996 Konishi et al. ..... 417/220
5,562,432 A * 10/1996 Semba et al. ..... 418/26
6,042,343 A * 3/2000 Semba et al. ..... 417/220
6,079,955 A * 6/2000 Miyazawa et al. ..... 417/213
6,217,296 B1 * 4/2001 Miyazawa et al. ..... 417/310
6,382,925 B1 * 5/2002 Oba et al. ..... 417/220

FOREIGN PATENT DOCUMENTS

JP 2932236 9/1999

* cited by examiner

*Primary Examiner*—Charles G. Freay
*Assistant Examiner*—Michael K. Gray
(74) *Attorney, Agent, or Firm*—Orum & Roth

(57) ABSTRACT

In a variable displacement pump, a pressurizing cylinder is provided in an opposite side of the first fluid pressure chamber, holding the cam ring there between, and a piston inserted to the pressurizing cylinder collides with the cam ring. A pressure in an upstream side of both throttle passages comprising the variable throttle passage and the fixed throttle passage provided in the pump discharge side passage is introduced to the first fluid pressure chamber and the oil chamber of the pressurizing cylinder, and a pressure in a downstream side of the both throttle passages is introduced to the second fluid pressure chamber.

6 Claims, 3 Drawing Sheets

VARIABLE DISPLACEMENT PUMP

BACKGROUND OF THE INVENTION

1. Field of the Invention

The present invention relates to a variable displacement pump employed for a power steering device or the like of a motor vehicle.

2. Description of the Related Art

Conventionally, there has been a variable displacement pump as disclosed in Japanese Patent No. 2932236 in order to assist steering force by means of a hydraulic power steering device of a motor vehicle. This conventional variable displacement pump is directly rotated and driven by means of an engine of the motor vehicle. This device provides a rotor in a cam ring engaged movably and displaceably with an adapter ring engaged with a pump casing, and forms a pump chamber between the cam ring and the periphery of the rotor.

Further, in this conventional art, as well as the cam ring is structured such as to be movable within the adapter ring and a biasing force making a capacity of the pump chamber maximum is applied to the cam ring by a spring, first and second fluid pressure chambers are separately formed between the cam ring and the adapter ring and there is provided a switch valve operating due to a pressure difference between upstream and downstream sides of a main throttle provided in a pump discharge side passage and controlling a fluid pressure supplied to both of the fluid pressure chambers in correspondence to a discharge flow amount of a pressurized fluid from the pump chamber so as to move the cam ring, thereby changing the capacity of the pump chamber so as to control the discharge flow amount from the pump chamber. Accordingly, in this variable displacement pump, the discharge flow amount is controlled to be relatively large so as to obtain a large steering assist force at a time when the motor vehicle stops or runs at a low speed, where the motor vehicle has a low rotational speed, and the discharge flow amount is controlled to be equal to or less than a fixed amount so as to make the steering assist force small at a time when the motor vehicle runs at a high speed, where the motor vehicle has a high rotational speed, whereby it is possible to generate the steering assist force required for the power steering device.

In this case, in the conventional art (Japanese Patent No. 2932236), since an opening range around a pump shaft of a discharge port open to a discharge area in a downstream side in a rotor rotating direction of the pump chamber is arranged so as to be shifted to a side of a second fluid pressure chamber, a force based on a pressure fluctuation (an increase of internal pressure of a cam ring) generated within the pump chamber moves the cam ring to a side of the second fluid pressure chamber so as to fluctuate the discharge flow amount of the pump at a time when a load is generated on the basis of operation of equipment to be used, such as a steering operation of a power steering device or the like. In Japanese Patent No. 2932236, it is described that since the fluid pressure in the downstream of the main throttle is substantially close to the discharge pressure which can resist against the increase of the internal pressure of the cam ring mentioned above, when this pressure is introduced into the second fluid pressure chamber, the movement mentioned above of the cam ring can be restricted by the introduction pressure, and the fluctuation of the flow amount mentioned above can be prevented. However, this description is an error. It is impossible to prevent the flow amount from being fluctuated.

Because the force (except the spring) applied to the cam ring is constituted by the fluid pressure of the first fluid pressure chamber, the second fluid pressure chamber, and the pump chamber, the fluctuation of the pressure is transmitted to all the area of the discharge system from the pump chamber to the equipment in use when the load is generated. At this time, since the force based on the pressure fluctuation generated in the first fluid pressure chamber and the force based on the pressure fluctuation generated in the second fluid pressure chamber have substantially the same area in their pressure receiving surfaces and are opposed to each other, they are cancelled with each other. However, the force based on the pressure fluctuation generated in the pump chamber leaves as before. This force moves the cam ring to the side of the second fluid pressure chamber so as to fluctuate the flow amount.

SUMMARY OF THE INVENTION

The object of the present invention is to restrict a fluctuation of a discharge flow amount when a load is generated, in a variable displacement pump.

According to the present invention, there is disclosed a variable displacement pump comprising: a rotor rotated and driven in a state of being fixed to a pump shaft inserted to a pump casing and receiving a multiplicity of vanes in a groove so as to be movable in a radial direction; a cam ring fitted to a fitting hole in the pump casing so as to form a pump chamber between the cam ring and an outer peripheral portion of the rotor, making it movable within the pump casing and forming first and second fluid pressure chambers between the cam ring and the pump casing.

An opening range around a pump shaft of a discharge port open to a discharge area in a downstream side in a rotor rotational direction of the pump chamber is shifted to a side of the second fluid pressure chamber.

A variable throttle passage and a fixed throttle passage bypassing the variable throttle passage are provided in the discharge passage of the pump.

A pressurizing cylinder is provided in an opposite side of the first fluid pressure chamber, holding the cam ring there between, and a piston inserted to the pressurizing cylinder collides with the cam ring.

Pressure in an upstream side of both throttle passages comprising the variable throttle passage and the fixed throttle passage provided in the pump discharge side passage is introduced to the first fluid pressure chamber and the oil chamber of the pressurizing cylinder. Pressure in a downstream side of the both throttle passages is introduced to the second fluid pressure chamber.

BRIEF DESCRIPTION OF THE DRAWINGS

The present invention will be more fully understood from the detailed description given below and from the accompanying drawings which should not be taken to be a limitation on the invention, but are for explanation and understanding only.

The Drawings

DESCRIPTION OF THE PREFERRED EMBODIMENTS

Figure 1:
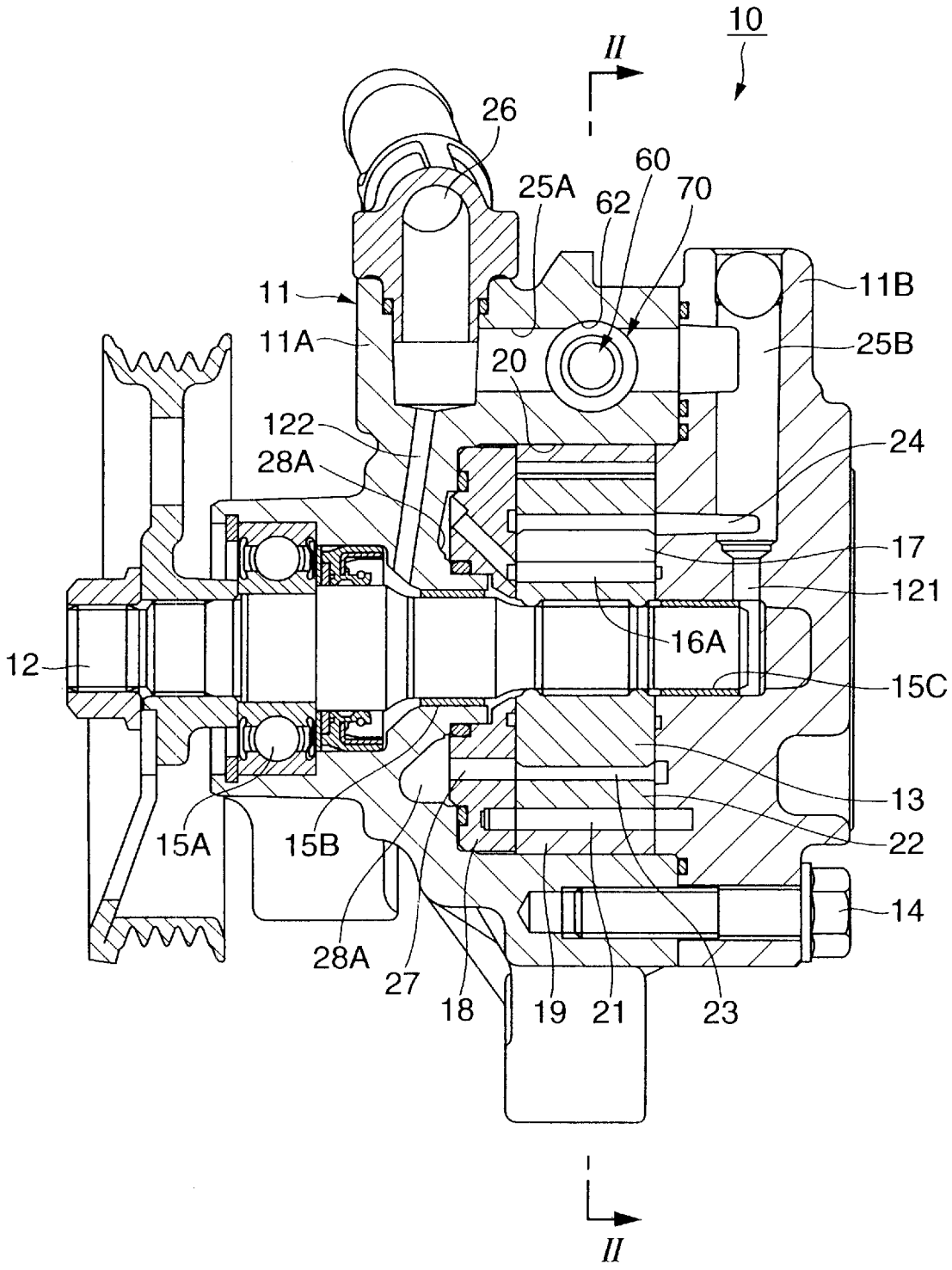
FIG. 1 is a sectional view showing a variable displacement pump.
Figure 2:
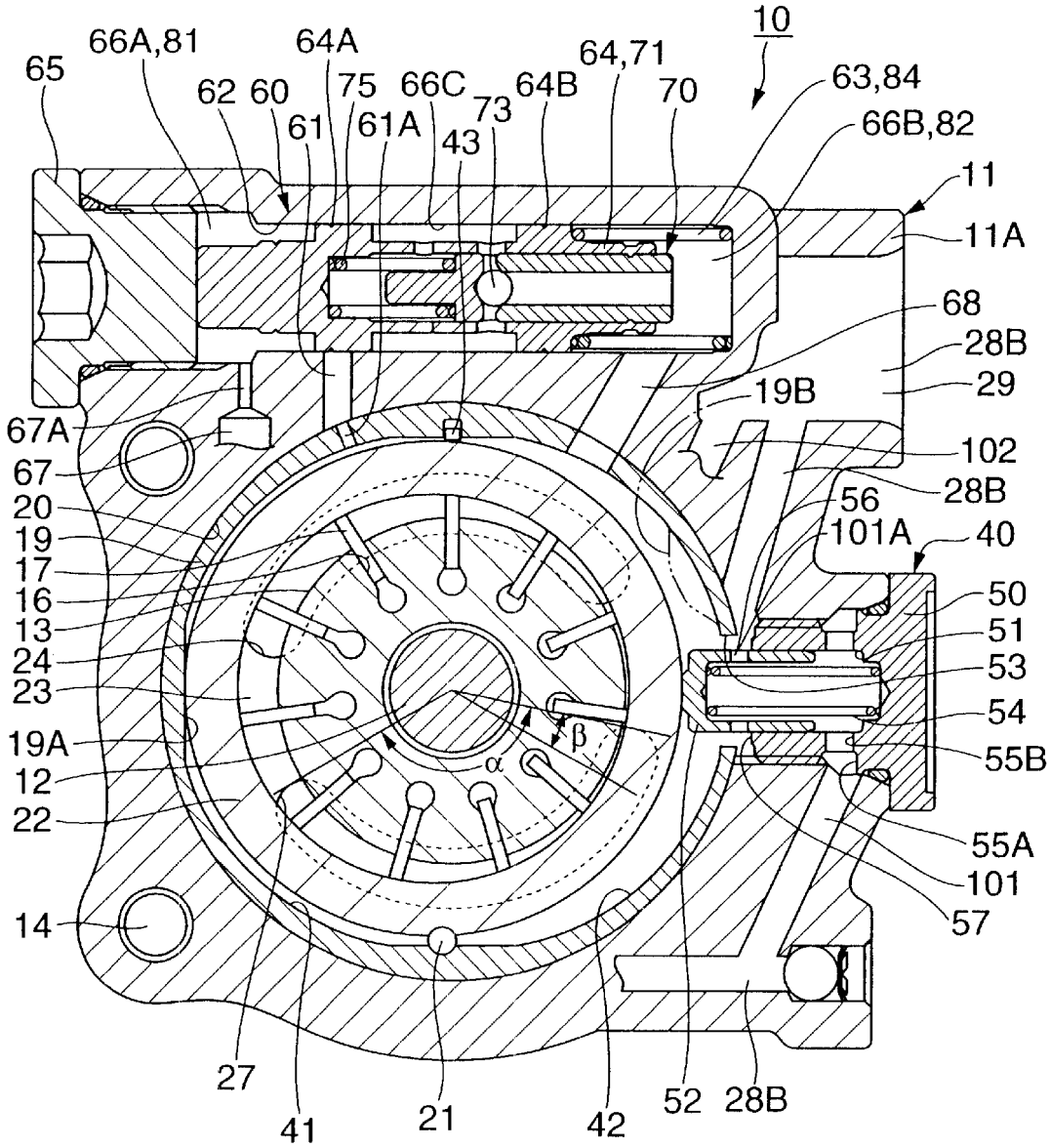
FIG. 2 is a sectional view taken along line II—II of FIG. 1.

A variable displacement pump 10 is a vane pump that is a hydraulic power generation source of a hydraulic power steering device of a motor vehicle. As shown in FIG. 1 and FIG. 2, the pump 10 includes a rotor 13 fixed to a pump shaft 12 inserted into a pump casing 11 by means of a serration to be driven rotatably. The pump casing 11 is arranged so as to integrate a pump housing 11A with a cover 11B by means of a bolt 14, to support the pump shaft 12 via bearings 15A to 15C. The pump shaft 12 can be directly driven rotatably by means of a motor vehicle engine.

The rotor 13 houses vanes 17 in grooves 16 provided at a plurality of peripheral positions, respectively, thereby making it possible to move each vane 17 in a radial direction along the groove 16.

A pressure plate 18 and an adapter ring 19 are engaged with an engagement hole 20 of the pump housing 11A of the pump casing 11 in a layered state. These plate 18 and ring 19 are fixed laterally by a cover 11B while they are positioned in the peripheral direction by means of a fulcrum pin 21 described later.

A cam ring 22 is engaged with the aforementioned adapter ring 19 fixed to the pump housing 11A of the pump casing 11. The cam ring 22 surrounds the rotor 13 with a certain quantity of eccentricity, and forms a pump chamber 23 between the pressure plate 18 and the cover 11B or the periphery of the rotor 13. On a suction area in the upstream side in the rotor rotation direction of the pump chamber 23, a suction port 24 provided at the cover 11B opens. A suction opening 26 of the pump 10 communicates with this suction port 24 via suction passages (drain passages) 25A and 25B provided at the housing 11A and the cover 11B. On a downstream area in the downstream side of the rotor rotation direction of the pump chamber 23, an ejection port 27 provided at a pressure plate 18 opens. An ejection opening 29 of the pump 10 is communicated with this ejection port 27 via a high pressure chamber 28A and an ejection passage 28B provided at the housing 11A.

In this manner, in the variable displacement pump 10, when the rotor 13 is rotatably driven by means of the pump shaft 12, and the vane 17 of the rotor 13 rotates while it is pressed to the cam ring 22 with centrifugal force, a capacitance between an interval of the adjacent vanes 17 and the cam ring 22 is expanded together with rotation on the upstream side in the rotor rotation direction of the pump chamber 23. Then, working fluid is suctioned from the suction port 24, the capacitance between the interval of the adjacent vanes 17 and the cam ring 22 is reduced together with rotation on the downstream side in the rotor rotation direction of the pump chamber 23, and the working fluid is ejected from the ejection port 27.

The variable displacement pump 10 is structured, as shown in FIG. 2, such that an opening range $\alpha$ around the pump shaft 12 of the discharge port 27 is arranged so as to be shifted to the side of a second fluid pressure chamber 42 mentioned below at an angle $\beta$.

Accordingly, the variable displacement pump 10 has a discharge flow amount control apparatus 40.

The discharge flow amount control apparatus 40 is structured such that the supporting point pin 21 mentioned above is mounted on a vertical lowermost portion of the adapter ring 19 mentioned above fixed to the pump casing 11. The vertical lowermost portion of the cam ring 22 is supported by the supporting point pin 21, and the cam ring 22 can be swingably displaced within the adapter ring 19.

The discharge flow amount control apparatus 40 is provided with a variable throttle passage 101 and a fixed throttle passage 102 which bypasses the variable throttle passage 101 in the discharge passage 28B of the pump 10 in parallel. A variable throttle 101A is provided in the variable throttle passage 101, and a fixed throttle 102A (not shown) is provided in the fixed throttle passage 102. The fixed throttle passage 102 is structured such that a flow passage is simple and short and a resistance loss is small, in comparison with the variable throttle passage 101 in which a flow passage is complex and long.

The discharge flow amount control apparatus 40 is provided in the pump housing 11A constituting the pump casing 11, in an opposite side to a first fluid pressure chamber 41 mentioned below in regard to the cam ring 22. A pressurizing cylinder 50 is provided being engaged in a sealed state in the pump housing 11A, holding an O-ring in between. An oil chamber 51 of the pressurizing cylinder 50 is interposed in a middle of the variable throttle passage 101, and a piston 52 inserted to the oil chamber 51 is in slidably contact with an outer surface of the cam ring 22 through a piston hole 53 provided in the adapter ring 19. A spring 54 corresponding to an energizing means is arranged in the oil chamber 51 of the pressurizing cylinder 50. The spring 54 energizes the cam ring 22 via the piston 52 with respect to the outer peripheral portion of the rotor 13 in a direction making a capacity (a pump capacity) of the pump chamber 23 maximum. The piston 52 is constituted by a closed-end cylindrical hollow body provided with a cavity receiving the spring 54.

In this case, the adapter ring 19 is structured such that a cam ring movement restricting stopper 19A is formed in a protruding shape in a part of an inner peripheral portion forming the first fluid pressure chamber 41, whereby it is possible to restrict a moving limit of the cam ring 22 for making the capacity of the pump chamber 23 maximum as mentioned below. The adapter ring 19 is structured such that a cam ring movement restricting stopper 19B is formed in a protruding shape in a part of an inner peripheral portion forming a second fluid pressure chamber 42 mentioned below so as to restrict a moving limit of the cam ring 22 for making the capacity of the pump chamber 23 minimum as mentioned below. A function of the stopper 19B is securing a fixed opening degree without fully closing the variable throttle 101A of the variable throttle passage 101 at a time when the pump 10 rotates at a high speed so as to maintain a fixed discharge flow amount, however, since the pump 10 can maintain the fixed discharge flow amount on the basis of an existence of the fixed throttle passage 102 bypassing the variable throttle passage 101, the stopper 19B may be omitted.

The discharge flow amount control apparatus 40 forms the first and second fluid pressure chambers 41 and 42 between the cam ring 22 and the adapter ring 19. The first fluid pressure chamber 41 and the second fluid pressure chamber 42 are separated between the cam ring 22 and the adapter 19 by the supporting point pin 21 and a seal member 43 provided at an axially symmetrical position. At this time, the first and second fluid pressure chambers 41 and 42 are sectioned both side portions between the cam ring 22 and the adapter ring 19 by the cover 11B and the pressure plate 18. They are provided with a communicating groove communicating the first fluid pressure chambers 41 separated into both sides of the stopper 19A with each other and a communicating groove communicating the second fluid pressure chambers 42 separated into both sides of the stopper 19B with each other, when the cam ring 22 is collided and aligned with the cam ring movement restricting stoppers 19A and 19B mentioned above in the adapter ring 19, in the pressure plate 18.

In this case, the oil chamber 51 of the pressurizing cylinder 50 mentioned above is provided with the variable throttle passage 101 of the pump 10. Accordingly, in the discharge path of the pump 10, the pressurized fluid discharged from the pump chamber 23 and reaching the variable throttle passage 101 of the discharge passage 28B via the discharge port 27 of the pressure plate 18 and the high pressure chamber 28A of the pump housing 11A is fed to a downstream side of the discharge passage 28B from an annular groove 55A around the pressurizing cylinder 50 and a passage 55B open onto a wall surface of the pressurizing cylinder 50 through the oil chamber 51. A piston 52 inserted to the oil chamber 51 of the pressurizing cylinder 50 has a hole-like communication passage 56 for communicating the oil chamber 51 with the discharge passage 28B in the downstream side in such a manner as to be pierced on a wall surface of the hollow body of the piston 52, and changes an opening area of the communication passage 56 with the discharge passage 28B in the downstream side by a front end edge 57 of the pressurizing cylinder 50 when the piston 52 moves in correspondence to the movement of the cam ring 22, thereby constituting a variable throttle 101A.

(1) The discharge flow amount control apparatus 40 may introduce the pressure in an upstream side of the throttle 101A of the variable throttle passage 101 and the throttle 102A of the fixed throttle passage 102 to the first fluid pressure chamber 41 applying the moving displacement in the direction making the capacity of the pump chamber 23 minimum to the cam ring 22, via a switch valve apparatus 60 mentioned below. (2) The discharge flow amount control apparatus 40 may introduce the pressure in a downstream side of the both of the throttles 101A and 102A to the second fluid pressure chamber 42 applying the moving displacement in the direction making the capacity of the pump chamber 23 maximum to the cam ring 22, from the discharge passage 28B via the piston hole 53 of the adapter ring 19. (3) The discharge flow amount control apparatus 40 may directly introduce the pressure in the upstream side of the both of the throttles 101A and 102A to the oil chamber 51 of the pressurizing cylinder 50 applying the moving displacement in the direction making the capacity of the pump chamber 23 maximum to the cam ring 22. Due to a balance of the pressures applied to the first fluid pressure chamber 41, the second fluid pressure chamber 42 and the oil chamber 51 of the pressurizing cylinder 50, it is possible to move the cam ring 22 against the biasing force of the spring 54 and change the capacity of the pump chamber 23, thereby controlling the discharge flow amount of the pump 10.

In this case, in the discharge flow amount control apparatus 40, there is provided the switch valve apparatus 60 operating on the basis of the pressure difference between the upstream and downstream sides of the both of the throttles 101A and 102A and controlling the fluid pressure supplied to the first fluid pressure chamber 41 in correspondence to the discharge flow amount of the pressurized fluid from the pump chamber 23. In particular, the switch valve apparatus 60 is interposed between a communication passage 61 connected to the first fluid pressure chamber 41 and a communication passage 67 disposed in an upstream side of the both of the throttles 101A and 102A in the discharge passage 28B, closes the first fluid pressure chamber 41 with respect to the communication passage 67 in a low rotational range of the pump 10 in association with a throttle 61A provided in the communication passage 61 and connects the first fluid pressure chamber 41 to the communication passage 67 in a high rotational range.

In this case, the switch valve apparatus 60 is structured such that a spring 63 and a switch valve 64 are received in a valve receiving hole 62 pierced in the pump housing 11A, and the switch valve 64 energized by the spring 63 is supported by a cap 65 engaged with the pump housing 11A. The switch valve 64 is provided with a valve body 64A and a switch valve body 64B, and is structured such that the communication passage 67 in the upstream side rather than the both of the throttles 101A and 102A of the discharge passage 28B is communicated with a pressurizing chamber 66A provided in one end side of the valve body 64A. A communication passage 68 in the downstream side rather than both of the throttles 101A and 102A of the discharge passage 28B is communicated with a back pressure chamber 66B in which a spring 63 provided in another end side of the switch valve body 64B is stored, via the second fluid pressure chamber 42. Further, a suction passage (a drain passage) 25A mentioned above is formed through a drain chamber 66C between the valve body 64A and the switch valve body 64B, and is in communication with a tank. The switch valve body 64B can open and close the communication passage 61 mentioned above. In a low rotational range having a low discharge pressure of the pump 10, the switch valve body 64B sets the switch valve 64 to an original position shown in FIG. 2 due to the biasing force of the spring 63 and closes the communication between the first fluid pressure chamber 41 and the communication passage 67 by the switch valve body 64B. In a middle and high rotational range of the pump 10, the switch valve body 64B moves the switch valve 64 due to the high pressurized fluid of the communication passage 67 applied to the pressurizing chamber 66A so as to open the communication passage 61, thereby introducing the high pressurized fluid of the communication passage 67 to the first fluid pressure chamber 41. In this case, a throttle 67A is provided in the communication passage 67 so as to make it possible to absorb a pulsation from the upstream sides of the main throttle 58.

Accordingly, a discharge flow amount characteristic of the pump 10 provided with the discharge flow amount control apparatus 40 is as follows.

(1) In a low speed running range of a motor vehicle in which the rotational speed of the pump 10 is relatively low, the pressure of the fluid discharged from the pump chamber 23 to the pressurizing chamber 66A of the switch valve apparatus 60 is also low. The switch valve 64 is positioned at the original position and the switch valve 64 closes the communication passage 61 with the first fluid pressure chamber 41. Accordingly, the pressure in the upstream side of the both of the throttles 101A and 102A is not supplied to the first fluid pressure chamber 41. The pressure in the downstream side of the both of the throttles 101A and 102A is applied to the second fluid pressure chamber 42, and the pressure in the upstream side of the both of the throttles 101A and 102A is applied to the oil chamber 51 of the pressurizing cylinder 50. Accordingly, the cam ring 22 is maintained in the side making the capacity of the pump chamber 23 maximum due to the pressure difference between the first fluid pressure chamber 41 and the second fluid pressure chamber 42, and due to the pressing force of the piston 52 of the pressurizing cylinder 50 and the biasing force of the spring 54. Thereby the discharge flow amount of the pump 10 is increased in proportion to the rotational speed.

(2) When the pressure of the fluid discharged from the pump chamber 23 to the pressurizing chamber 66A of the switch valve apparatus 60 becomes high due to an increase of the rotational speed of the pump 10, the switch valve apparatus 60 moves the switch valve 64 against the biasing force of the spring 63 so as to open the communication passage 61 with the first fluid pressure chamber 41.

Accordingly, the pressure of the first fluid pressure chamber 41 is increased and the cam ring 22 moves to the side reducing the capacity of the pump chamber 23. Therefore, the discharge flow amount of the pump 10 cancels the flow amount increase caused by the increase of the rotational speed and the flow amount reduction caused by the reduction of the capacity in the pump chamber 23, so as to maintain a fixed relatively large flow amount.

(3) When the rotational speed of the pump 10 is continuously increased more and the cam ring 22 is further moved, whereby the cam ring 22 presses the spring 52 of the pressuring cylinder 50 at an amount over a fixed amount, the variable throttle 101A is throttled due to the movement of the piston 52. Accordingly, the discharge flow amount pressure fed to the downstream side of the discharge passage 28B of the pump 10 is reduced in proportion to the throttling amount of the variable throttle 101A.

(4) When reaching a high speed drive range of the motor vehicle in which the rotational speed of the pump 10 is over a fixed value, the cam ring 22 reaches a moving limit where the cam ring 22 is collided and aligned with the stopper 19B of the adapter ring 19. The throttling amount of the variable throttle 101A becomes maximum (The stopper 19B may be omitted and the variable throttle 101A may be fully closed.), and the discharge flow amount of the pump 10 maintains a fixed small flow amount.

In this case, the pump 10 has a relief valve 70 corresponding to the switch valve relieving an excessive fluid pressure in the pump discharge side among the high pressure chamber 28A, the suction passage (the drain passage) 25A and the drain chamber 66C. Further, in the pump 10, a lubricating oil supply passage 121 from the suction passage 25B toward the bearing 15C of the pump shaft 12 is pierced in the cover 11B, and a lubricating oil return passage 122 returning from a peripheral portion of the bearing 15B of the pump shaft 12 to the suction passage 25A is pieced in the pump housing 11A.

Figure 3:
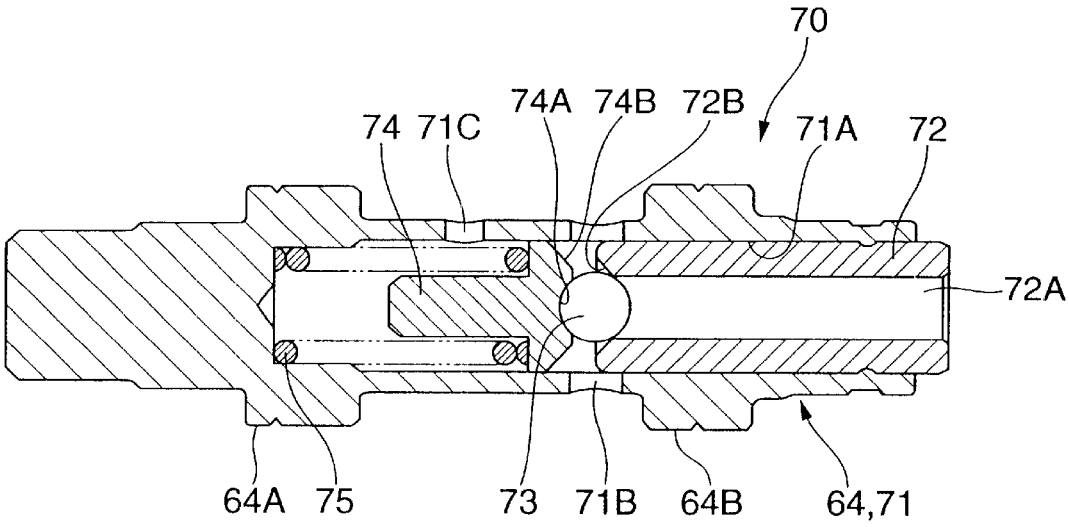
FIG. 3 is a cross sectional view showing a switch valve.

The relief valve 70 is structured in a pilot-drive type in which a ball 73 constructing a pilot valve is added to a main valve 71 installed in the switch valve apparatus 60 and constituted by the switch valve 64 itself as shown in FIG. 3. The main valve 71 can open and close an upstream side passage of the both of the throttles 101A and 102A provided in the pump discharge side passage, that is, a first valve chamber (the same as the pressurizing chamber 66A) 81 with respect to the drain passage 25A (suction passage). A fluid pressure in the downstream side of both of the throttles 101A and 102A provided in the pump discharge side passage is applied to the ball 73, and further, a fluid pressure of the second valve chamber (the same as the back pressure chamber 66B) 82 as well, is applied to the ball 73.

In particular, the relief valve 70 is provided with the following structure (a) to (c).

(a) The relief valve 70 is provided with the main valve 71 (the switch valve 64) slidably within the valve receiving hole 62, and applies the fluid pressure in the upstream side of both of the throttles 101A and 102A provided in the discharge side passage of the pump 10 to the first valve chamber 81 (the pressurizing chamber 66A) defined in one end side of the valve receiving hole 62 with respect to the main valve 71. The relief valve 70 applies the fluid pressure in the downstream side of the both of the throttles 101A and 102A to the second valve chamber 82 (the back pressure chamber 66B) defined in another end side of the valve receiving hole 62 with respect to the main valve 71. The relief valve 70 is provided with a relief passage 83 (not shown) communicating the first valve chamber 81 with the drain passage 25A via the drain chamber 66C in the valve receiving hole 62, and is provided with a spring 84 (the same as the spring 63) energizing the main valve 71 to a side of the first valve chamber 81 so as to set the main valve 71 to a close position of the relief passage 83.

(b) The relief valve 70 has a main valve 71 in which an axial hole 71A for relieving the fluid pressure is formed and a relief hole 71B crossing the axial hole 71A is formed so as to be slidably provided in the valve receiving hole 62, a valve seat 72 provided with a communication hole 72A inserted and attached to an inflow side opening end of the axial hole 71A in the main valve 71 so as to communicate the internal and external portions of the axial hole 71A. This includes a ball receiving surface 72B formed in an outflow side end of the communication hole 72A, a ball 73 movably provided in the axial hole 71A of the main valve 71 and capable of being brought into contact with the ball receiving surface 72B in the valve seat 72, and a spring presser 74 provided with a ball pressing surface 74A provided in the axial hole 71A of the main valve 71 and pressing the ball 73 to the ball receiving surface 72B of the valve seat 72 while being backed up by a spring 75. In this case, reference symbol 71C denotes a fluid pressure relief hole (a relief hole) provided in a side wall of the axial hole 71A receiving the spring 75 of the main valve 71 and opposing to the drain chamber 66C and the drain passage 25A for making the movement of the spring presser 74 smooth.

(c) The ball receiving surface 72B of the valve seat 72 in the relief valve 70 is formed as a tapered surface expanding toward a direction in which the fluid flows out in an axial direction of the communication hole 72A. At the same time, the peripheral end surface 74B of the ball pressing surface 74A in the spring presser 74 is formed as a tapered surface expanding toward an opposite direction to the ball pressing direction in the axial direction of the spring presser 74.

The relief valve 70 is structured such that when the fluid pressure in the pump discharge side becomes excessive due to a continuous static turn steering state generated by the power steering device in which the pump 10 is used, or the like, and the fluid pressure of the second valve chamber 82 connected to the discharge passage in the downstream side of the both of the throttles 101A and 102A reaches the relief set pressure, the fluid pressure of the second valve chamber 82 opens the ball 73 against the urging of the spring 75. Accordingly, it is possible to relieve the fluid pressure of the second valve chamber 82 from the relief hole 71B to the drain passage 25A via the drain passage 66C so as to open the main valve 71 against the spring 84 due to the fluid pressure of the first valve chamber 81 under the state that the fluid pressure of the second valve chamber 82 is reduced by this relief, so that it is possible to relieve the fluid pressure of the first valve chamber 81 from the relief passage 83 to the drain passage 25A via the drain chamber 66C. Therefore, it is possible to relieve the excessive fluid pressure in the pump discharge side.

According to the present embodiment, the following operations can be obtained.

(1) The force (except the spring 54) applied to the cam ring 22 is constituted by the fluid pressure of the first fluid pressure chamber 41, the second fluid pressure chamber 42, the oil chamber 51 of the pressurizing cylinder 50 and the pump chamber 23. Because of this condition, the fluctuation of the pressure is transmitted to the entire area of the discharge system from the pump chamber 23 to the equipment to be used, when the load is generated. At this time, since the force based on the pressure fluctuation generated in the first fluid pressure chamber 41 and the force based on the pressure fluctuation generated in the second fluid pressure chamber 42 have substantially the same area in their pressure receiving surfaces and are opposed to each other, they cancel each other. The force based on the pressure fluctuation generated in the pump chamber 23 is opposed by the pressing force of the piston 52 based on the pressure fluctuation generated in the oil chamber 51 of the pressurizing cylinder 50, so that the force based on the pressure fluctuation generated in the pump chamber 23 moves the cam ring 22 in the side of the second fluid pressure chamber 42 so as to restrict the fluctuation of the discharge flow amount.

(2) The fixed throttle passage 102 bypassing the variable throttle passage 101 is additionally provided at a time when the variable throttle passage 101 is provided in the pump discharge side passage 28B so as to obtain the discharge flow amount property for reducing and controlling the discharge flow amount at a time of increasing the rotational number of the pump 10. In the structure made such that the pump side discharge passage 28B is constituted only by the variable throttle passage 101, since the pump discharging side passage 28B is constituted only by the complex and long flow passage having a large resistance loss in the variable throttle passage 101, it is impossible to sufficiently secure the discharge amount at a low temperature starting time at which the fluid has a high viscosity and is hard to flow. It is necessary to pass all the amount of the maximum discharge flow amount of the pump 10 only by the variable throttle passage 101, so that the pump size is increased in correspondence that it is necessary to secure a great full open area in the variable throttle 101A. On the contrary, according to the present embodiment, since the flow passage becomes simple and short in comparison with the variable throttle passage 101, the fixed throttle passage 102 having the small resistance loss is additionally provided, so that it is possible to secure the sufficient discharge amount at the low temperature starting time at which the fluid has the high viscosity and is hard to flow, and all the amount of the maximum discharge flow amount of the pump 10 is passed by both of the fixed throttle passage 102 and the variable throttle passage 101. Accordingly, the full open area of the variable throttle 101A can be reduced to a controlled amount of the discharge flow amount, and the pump size can be reduced.

(3) Since the communication passage 56 of the piston 52 communicated with the oil chamber 51 of the pressurizing cylinder 50 is set to the variable throttle 101A, the rotational number of the pump 10 is increased. When the cam ring 22 is going to move to the side reducing the capacity of the pump chamber 23 due to the balance of the force mentioned in the item (1) mentioned above, it is possible to throttle the variable throttle 101A due to the movement of the piston 52 together with the movement of the cam ring 22. It is possible to reduce the discharge flow amount pressure fed to the downstream side of the discharge passage 28B of the pump 10 in proportion to the throttle amount of the variable throttle 101A.

(4) Since the spring 54 corresponding to the energizing means for energizing the cam ring 22 in the direction in which the capacity of the pump chamber 23 becomes maximum is provided, the cam ring 22 can always be maintained in the original state in which the capacity of the pump chamber 23 becomes maximum at a time of starting rotation of the pump 10 so as to stabilize the moving control of the cam ring 22. Since the spring 54 is arranged in the oil chamber 51 of the pressurizing cylinder 50, it is possible to make the shape of the pump 10 compact while having both of the pressurizing cylinder 50 and the spring 54.

As mentioned above, according to the present invention, in the variable displacement pump, it is possible to restrict the fluctuation of the discharge flow amount at a time when the load is generated.

As heretofore explained, embodiments of the present invention have been described in detail with reference to the drawings. However, the specific configurations of the present invention are not limited to the embodiments but those having a modification of the design within the range of the present invention are also included in the present invention.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A variable displacement pump comprising:

a rotor rotated and driven in a state of being fixed to a pump shaft inserted to a pump casing and receiving a multiplicity of vanes in a groove so as to be movable in a radial direction;

a cam ring fitted to a fitting hole in the pump casing so as to form a pump chamber between the cam ring and an outer peripheral portion of the rotor, being movable within the pump casing and forming first and second fluid pressure chambers between the cam ring and the pump casing; and an opening range around the pump shaft of a discharge port open to a discharge area in a downstream side in the rotor rotational direction of the pump chamber being shifted to a side of the second fluid pressure chamber, wherein a variable throttle passage and a fixed throttle passage bypassing the variable throttle passage are provided in a discharge side passage of the pump, a pressurizing cylinder being provided in an opposite side of the first fluid pressure chamber holding the cam ring there between and a piston inserted to the pressurizing cylinder which collides with the cam ring, and a pressure in an upstream side of both throttle passages comprising the variable throttle passage and the fixed throttle passage provided in the pump discharge side passage is introduced to the first fluid pressure chamber and the oil chamber of the pressurizing cylinder, and a pressure in a downstream side of the both throttle passages is introduced to the second fluid pressure chamber.

2. A variable displacement pump as claimed in claim 1, wherein the oil chamber of the pressurizing cylinder is provided in the variable throttle passage, a communication passage of a piston communicating with the oil chamber of the pressurizing cylinder is set to the variable throttle, and an opening area of the communication passage is changed by an edge of the pressurizing cylinder.

3. A variable displacement pump as claimed in claim 1, wherein an energizing means is arranged in the oil chamber of the pressurizing cylinder, and the energizing means energizes the cam ring via a piston in a direction making the pump capacity with respect to the outer peripheral portion of the rotor maximum.

4. A variable displacement pump as claimed in claim 2, wherein an energizing means is arranged in the oil chamber of the pressurizing cylinder, and the energizing means energizes the cam ring via the piston in a direction making the pump capacity with respect to the outer peripheral portion of the rotor maximum.

5. A variable displacement pump as claimed in claim 3, wherein the energizing means is a spring, and the piston is constituted by a closed-end cylindrical hollow body provided with a cavity receiving the spring.

6. A variable displacement pump as claimed in claim 4, wherein the energizing means is a spring, and the piston is constituted by a closed-end cylindrical hollow body provided with a cavity receiving the spring.

* * * * *